United States Patent [19]

Sinnott

[11] 4,208,793

[45] Jun. 24, 1980

[54] FIRE FIGHTING DEVICE

[76] Inventor: Richard Sinnott, 5041 S. Keating, Chicago, Ill. 60632

[21] Appl. No.: 923,375

[22] Filed: Jul. 10, 1978

[51] Int. Cl.[2] ..... B26B 3/00

[52] U.S. Cl. ..... 30/299; 7/161; 30/314; 30/315; 30/353

[58] Field of Search ..... 30/299, 353, 314, 315; 7/161; 403/199, 244, 287

[56] References Cited

U.S. PATENT DOCUMENTS

| | | | |
|---|---|---|---|
| D. 153,776 | 5/1949 | Eimmerman | 30/294 |
| 676,961 | 6/1901 | Parks | 30/314 |
| 1,194,044 | 8/1916 | Loomis | 30/353 |
| 1,374,336 | 4/1921 | Surbaugh | 403/244 |
| 1,855,975 | 4/1932 | Lamb | 30/353 |
| 1,875,612 | 9/1932 | Johnson | 30/315 |
| 2,015,916 | 10/1935 | Blocher | 30/314 |
| 2,017,369 | 10/1935 | McGhee | 30/294 |
| 2,517,840 | 8/1950 | Chatlos | 30/299 |

FOREIGN PATENT DOCUMENTS

| | | | |
|---|---|---|---|
| 1140944 | 3/1957 | France | 403/199 |

*Primary Examiner*—Othell M. Simpson
*Assistant Examiner*—J. T. Zatarga
*Attorney, Agent, or Firm*—James J. Conlon

[57] ABSTRACT

A fire fighting device is provided for breaking holes in ceilings, walls, and the like. A battering and cutting edge that extends downwardly from a pointed tip, and a horizontal or bottom blade extends perpendicular to the axis of an adapting means which is attached to the blade portion and to a pole for gripping by the fire-fighter. The bottom blade includes a fulcrum spaced away from the tip a first distance and protruding below the bottom cutting edge to thereby allow the battering and cutting means to pivot securely for use in pulling down walls and removing sections of ceilings. The cutting blade is a heavy gauge metal which includes a contoured portion that permits the pole-attached adapter to be nestled therein for purposes of securely attaching the adapter to the cutting blade by a filler metal.

1 Claim, 4 Drawing Figures

FIRE FIGHTING DEVICE

BACKGROUND OF THE INVENTION (1) Field of the Invention

This invention pertains to hand-held fire fighting equipment used by firemen for purposes of battering holes in ceilings and walls to expose fire therein to fire fighting water or chemicals.

(2) Description of the Prior Art

The prior art of fire fighting devices of this nature or so-called pike poles have generally provided a straight sharpened, piercing portion which is used to initially batter holes in walls and ceilings and also included a hook-shaped portion spaced a short distance from the pointed portion which is used to grip portions of the wall and pull it away to expose the fire within. While these so-called pike poles have been used for a great length of time by fire fighters, they have been subject to some criticism because they are able to poke only a small hole in the ceiling and when the hooked portion is used to pull the ceiling backwards, oftentimes, only a small portion of the ceiling breaks away because the hooked portion is not large enough to contact a great enough area of the ceiling to permit a large opening to be made. These problems are overcome by the device disclosed herein.

SUMMARY OF THE INVENTION

This invention pertains to a hand-held fire fighting device used by firemen for purposes of battering holes in walls, ceilings, and the like in order that the fire contained therein may be more easily extinguished. As is known by fire fighters, fire engineers and safety engineers, fire spreads at a rapid rate once it enters into the walls and ceilings of a structure. Therefore, it is necessary to expose the fire travelling within these portions of the building in order that fluids such as water may be used to extinguish the fire. It is necessary to move quickly when a fire is observed within a wall or ceiling to provide a large enough opening in that portion of the building in order to introduce water to rapidly and thoroughly extinguish the fire.

In operation, the fire fighting device disclosed herein provides a high capacity, efficient product whereby a heavy duty battering and cutting member is permanently attached atop an adapter which may be connected to various lengths poles for use as required by fire fighters.

A relief or contour on the blade portion provides a recess into which the adapter may be nested. A filler metal is then used to effect a joint between the two members. By nesting securely within the contour of the blade sufficient contact is maintained between the adapter and the blade portion to insure a reliable connection.

The heavy duty blade is provided with a point which is used to initially break through a wall or ceiling and extending from the point are sharpened edges which are used to cut through the ceiling. Once through the ceiling or wall the blade may then be turned 90 degrees or so and pulled backward into the room in order to remove a large chunk of the wall or ceiling. Once the cutting blade is through the wall or ceiling it may also be used as a prying member which digs into the hidden side of the wall or ceiling and securely attaches the cutting blade while the tip may then be pivoted against the opposite side to provide the force multiplication of a lever to assist in removing a portion of the wall.

It is thus an object of this invention to provide an improved piece of fire fighting equipment which is a hand-held instrument used by fire fighters to batter holes in walls and ceilings to provide access to the fire which is being transmitted within the wall and spreading rapidly throughout the building. The device disclosed herein may also be used to break down doors due to its strength and design which provides multiple cutting edges, thus relieving the fire fighter of carrying both an axe and the conventional pike pole.

Another object of this invention is to provide a single piece blade having sharpened edge portions and a contoured section to provide an efficient, reliable point of attachment to an adapter which is then may be attached to poles of various lengths.

Another object of the invention is to provide a sharpened, pointed fulcrum extending beneath one of the cutting edges and which may be used to securely attach the cutting blade on the interior of a wall to allow the fire fighting device to be used as a pry bar for separating the wall or ceiling.

These and other objects of the invention will become apparent to those having ordinary skill in the art with reference to the following description, drawings and claims.

DETAILED DESCRIPTION

Figure 1:
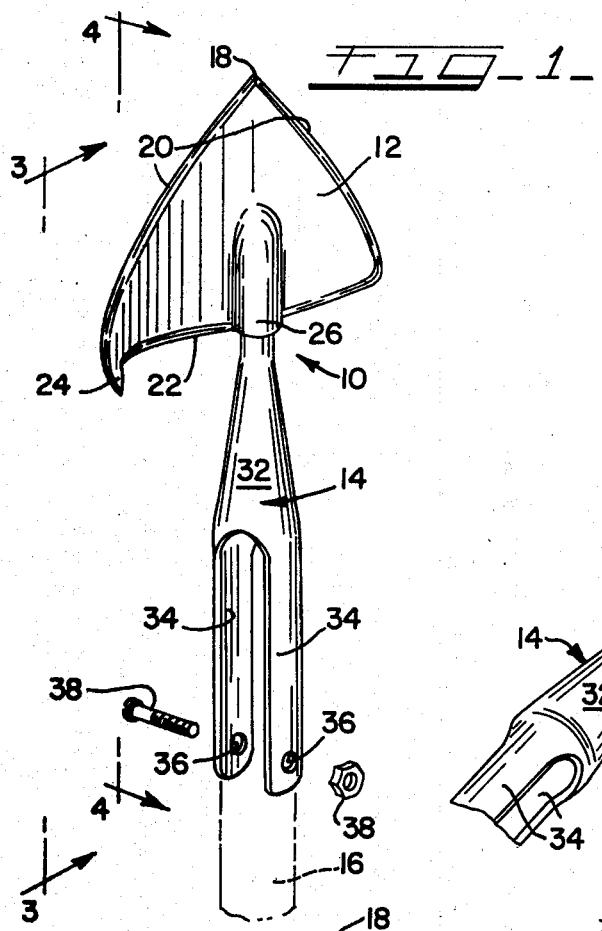
FIG. 1 is a pictorial illustration of the fire fighting device.

Referring now to the drawings and in particular to FIG. 1, there is shown a pictorial illustration of the fire fighting device 10. The fire fighting device 10 includes a battering and cutting blade designated 12 located at the end of a pole 16. A permanently attached adapter 14 is used to produce a solid connection between the two members. As shown in FIG. 1, the pole which is gripped by a fire fighter is indicated schematically and designated by the numeral 16.

The battering and cutting blade 12 includes a sharpened tip 18 which is used to initially break the surface of a wall or ceiling. Extending downwardly and outwardly away from tip 18 are a pair of blade edges 20 which are sharpened to assist in the insertion of the blade 12 into a wall or ceiling. Blades 20 extend to a lower or bottom edge 22 which extends generally at right angles to the longitudinal axis of the adapter 14. Bottom edge 22 may also be sharpened somewhat but it is anticipated that this edge is rather dull. Therefore, after the blade 12 is initially inserted through a ceiling it may be rotated slightly followed by a pulling backward into the room at which time the blades 20 contact the hidden side of the ceiling. Because blade 20 is dull it will force a large chunk of the ceiling to be pulled away to expose any fire within the ceiling to fire fighting fluids such as water, $C0_2$, and the like.

This fire fighting device may also be used as a battering ram to cut through or knock down doors.

Figure 4:
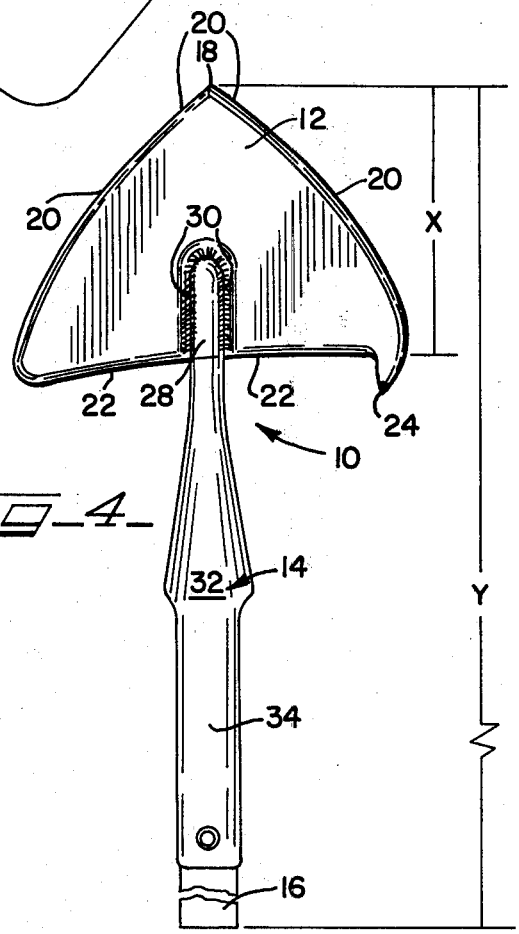

As shown in the drawings, a fulcrum point 24 protrudes from at least one corner of the blade 12. This fulcrum point is utilized to permit the fire fighting device 10 to be used as a lever once it is positioned inside a wall or ceiling. For example, after the blade portion 12 is pushed through a portion of the ceiling, the tip 18 or a portion of the blades 20 may come in contact with a rafter and thus allow that portion of the blade to be a contact point for allowing the blade to function as a lever in removing large chunks of wall or ceiling. As shown in FIG. 4, if the tip 18 is in contact with an interior portion of the wall or ceiling and spaced a distance X from the fulcrum point 24 and the pole portion is grasped by the fire fighter a distance Y away from the tip 18 a lever ratio of Y/X is obtained. Thus, if the distance X is one half foot and the distance Y is eight feet, a fulcrum ratio of 16 to 1 is available. Assuming a fire fighter is capable of exerting a force of 250 pounds to the end of the pole 16 a force of 4000 pounds may be brought to bear against the ceiling. The advantages of this fire fighting device 10 are far in excess of any device which is currently available due to its ramming and cutting ability but also do to this force multiplication feature. It is also possible that each end of the blade can be provided with a fulcrum point 24.

Figure 2:
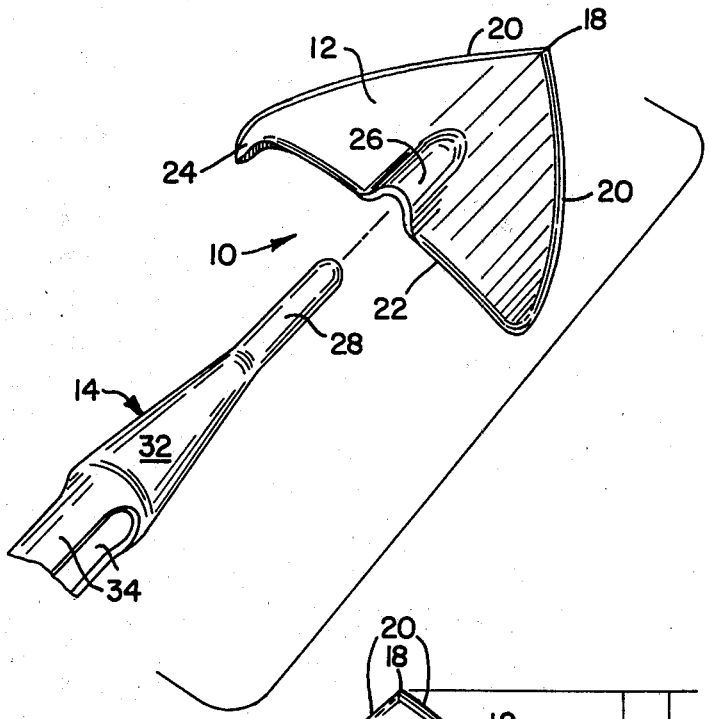
FIG. 2 is an exploded view of the fire fighting device.
Figure 3:
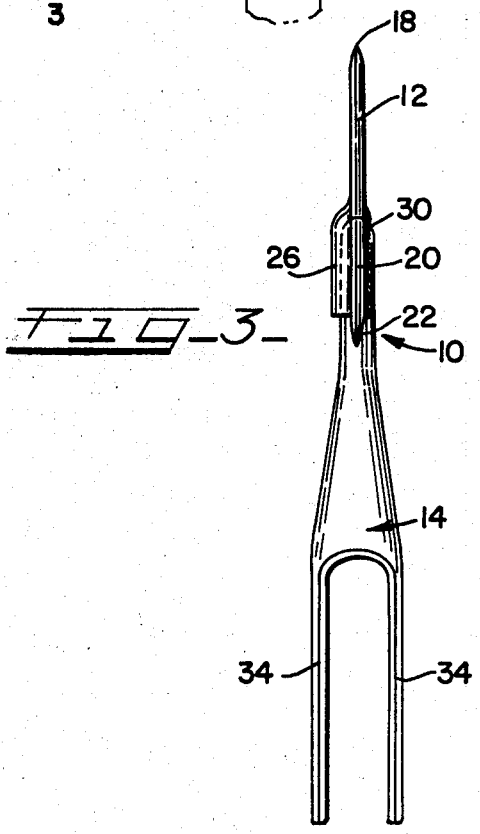
FIG. 3 is a side elevational view taken generally along lines 3—3 of FIG. 1; and, FIG. 4 is a frontal or elevational view taken generally along lines 4—4 of FIG. 1.

As shown in FIG. 2, the fire fighting device 10 is constructed in such a fashion that failures are minimized at the point of connection. To bring about such a safe connection the blade 12 has a contoured relief 26 which is adapted to receive the neck 28 of adapter 14. Thus, as shown in FIGS. 3 and 4, after the neck is nested into the relief 26 a filler metal may completely surround the neck 28 for securely attaching the blade 12 to adapter 14.

The adapter 14 has a truncated cone portion 32 which forms a transition between the neck 28 and a pair of spaced, rounded attaching legs 34.

Thus, as shown in FIG. 1 an attaching pole 16 may be fitted between the legs 34 and fitted up partially into the truncated cone 32. Once in position, fasteners 38 are utilized to securely urge the legs 34 into secure holding engagement with the pole 16. Thus, it is shown from the foregoing description that a piece of fire fighting equipment is provided that has not only unique functional features in providing an ability to effectively batter through a wall or ceiling but also provides novel features that allow it to function as a lever to provide tremendous force multiplication to a fire fighter. The unique construction also insures that a reliable device is provided that will not fail under stress.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A fire fighting device for attachment to a hand-held pole for battering and cutting holes in walls and other parts of buildings, the improvement comprising:

blade means for battering and cutting;

adapter means for connecting the blade means to the pole;

said blade means having a tip spaced from said adapter means;

a pair of blade edge means extending in opposite directions from said tip;

said blade means having a bottom edge extending across the blade means generally at right angles to the adapter means;

fulcrum means spaced away from the tip at a first distance and having pointed means protruding below the bottom edge for gripping a portion of a building in order that the fire fighting device may function as a lever member to multiply applied forces;

said blade means including contoured attaching means integrally formed therein and weld means cooperative with the adapter means for receiving the adapter means for attachment of a pole;

said contoured attaching means of the blade means comprising formed means permanently indented therein;

said formed means providing a recess extending from the bottom edge and terminating at an end located between said bottom edge and said tip;

said adapter means having a cylindrical end adapted for attachment to the formed means permanently indented in said blade means;

said formed means having a shape to receive the cylindrical end of the adapter means;

filler metal forming a metallurgical connection between the formed means and said cylindrical end of the adapter means to securely attach the adapter means to the blade means;

said adapter means including spaced leg members having an arcuate contour and adapted to grip the pole; and truncated cone means having a bottom portion attached to the spaced leg members and having a top portion attached to the cylindrical end adapted to be metallurgically attached to the formed means of the blade means.

* * * * *